United States Patent [19]

Porterfield

[11] 4,131,374

[45] Dec. 26, 1978

[54] DUAL SEGMENT CONTINUOUS MOTION RIBBON FEED MECHANISM

[75] Inventor: Richard F. Porterfield, Cortland, N.Y.

[73] Assignee: SCM Corporation, New York, N.Y.

[21] Appl. No.: 825,737

[22] Filed: Aug. 18, 1977

[51] Int. Cl.[2] ..... B41J 33/14

[52] U.S. Cl. ..... 400/232; 400/208; 400/225; 400/226

[58] Field of Search ..... 197/151, 160; 74/124

[56] References Cited

U.S. PATENT DOCUMENTS

| | | | |
|---|---|---|---|
| 1,547,150 | 7/1925 | Von Pein | 197/151 |
| 1,547,267 | 7/1925 | Shipley | 197/151 |
| 1,643,266 | 9/1927 | Aichele | 197/160 |
| 2,609,077 | 9/1952 | Schroder | 197/151 |
| 3,348,650 | 10/1967 | Meinherz et al. | 197/151 |
| 3,349,887 | 10/1967 | Goff | 197/151 |
| 3,401,783 | 9/1968 | Norwood et al. | 197/151 |
| 3,444,979 | 5/1969 | Francisco | 197/151 |
| 3,613,857 | 10/1971 | Thevis et al. | 197/151 |
| 3,724,633 | 4/1973 | Korb et al. | 197/151 |
| 3,788,442 | 1/1974 | Lehnhardt et al. | 197/151 X |
| 3,804,227 | 4/1974 | Cappotto et al. | 197/151 |

*Primary Examiner*—Ernest T. Wright, Jr.

*Attorney, Agent, or Firm*—Kenneth W. Greb; Ernest F. Weinberger; Milton M. Wolson

[57] ABSTRACT

A ribbon feed mechanism for typewriters operable to incrementally feed a ribbon with a dual segment continuous motion ribbon feed. The ribbon is advanced an initial segment by a power actuated linkage and advanced a final segment by a spring urged arm acting on a multi-toothed cam. The initial segment feed occurs when a bellcrank is pivoted, and through a linkage, urges a ribbon metering shaft to rotate which, in turn, feeds the ribbon. Simultaneously, a spring biased cam follower is gradually displaced by the multi-toothed cam which is supported on the metering shaft. The final segment feed occurs as the spring biased cam follower is rapidly displaced down a cam surface of a tooth on the multi-toothed cam.

9 Claims, 4 Drawing Figures

DUAL SEGMENT CONTINUOUS MOTION RIBBON FEED MECHANISM

BACKGROUND OF THE INVENTION

The present invention relates to typewriters, and more particularly to a ribbon feed mechanism operable to incrementally feed the ribbon by a dual segment continuous motion.

Typewriters with different ribbon feed requirements have prompted the development of feed systems with different characteristics. For example, a U.S. Pat. No. 3,444,979 granted to Bernardino Francisco on May 20, 1969 teaches a ribbon feeding device that insures efficient use of a printing ribbon by compensating for the variation in widths of characters being printed. The ribbon in the Francisco device is advanced by parallel pawls which are reciprocated to alternately engage a ratchet feed during a typing operation to provide two increment feeding. The ribbon is advanced a minor increment by the first pawl during the forward stroke of the pawls when one group of type is printed. The ribbon is advanced a major increment by the second pawl during the return stroke of the pawls when a second group of type is printed. A U.S. Pat. No. 3,788,442 granted to Lehnhardt Jr. et al on Jan. 29, 1974 discloses a cam operated ribbon mechanism for adhesive erase ribbon. A pre-print feed increment and a post-print feed increment of the erase ribbon is provided to prevent the adhesive ribbon from contacting adjacent structures in the typewriter. Both of the foregoing examples teach a dual increment ribbon feed for different ribbon systems. Neither system of the foregoing examples is a continuous ribbon feed and neither system allows for the use of a non-precise mechanism to accomplish a precise incremental ribbon feed as does the instant invention. Furthermore, the same power that is provided for the initial ribbon feed segment of the instant invention is also used for the final ribbon feed segment. Moreover, the power generated to drive the ribbon mechanism the initial segment is substantially reduced to drive the ribbon mechanism the final segment due to a spring urged cam follower rapidly displacing along the cam surface of a tooth on the multi-toothed cam. The reduced power minimizes wear between a power roll and an engaging pawl to drive the ribbon mechanism.

SUMMARY OF THE INVENTION

In the illustrated embodiment of the present invention, there is shown a dual segment ribbon feed assembly that is linked to a typewriter power system, to incrementally feed ribbon from a ribbon supply, which in this case is a cartridge. Upon typebar actuation, a power actuator connected to a ribbon feed bellcrank rotates the bellcrank. The bellcrank is connected to a mechanism on a ribbon feed metering shaft for rotating the shaft. A feed roller on the metering shaft engages the ribbon of an inserted ribbon cartridge for incrementally feeding the ribbon.

Ribbon is continuously fed within the ribbon cartridge in two segments. An initial segment of coarse ribbon feed occurs when the ribbon feed bellcrank actuates the mechanism which rotates the metering shaft. A final segment or fine ribbon feed occurs when a spring urged cam follower rapidly rides down a cam surface of a tooth on a multi-toothed cam and detents between two cam teeth. The multi-toothed cam is supported on the metering shaft. The detenting of the cam follower prevents any ribbon feed back-up of the metering shaft thereby more accurately controlling the ribbon feed.

Accordingly, an object of the present invention is to provide a non-precise mechanism for typewriters operable to accurately meter feed ribbon.

Another object of the present invention is to provide a dual segment ribbon feed mechanism for typewriters.

A further object of the present invention is to provide a continuous motion dual segment ribbon feed mechanism for typewriters.

Other objects, features, and advantages of the invention will become more apparent from the following description, including appended claims and accompanying drawing.

DESCRIPTION OF THE PREFERRED EMBODIMENT

Figure 1:
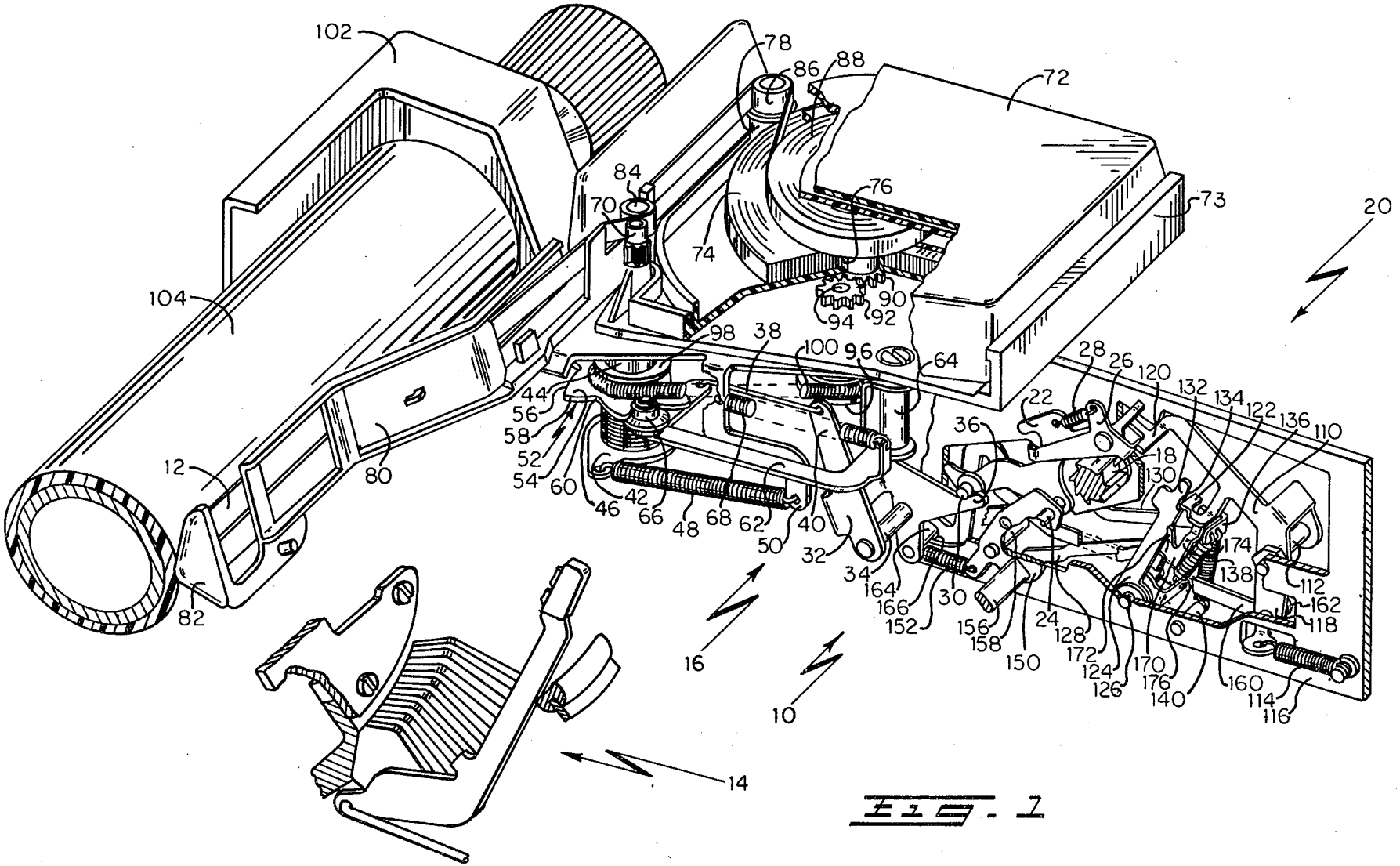
FIG. 1 is a front perspective view of the ribbon feed mechanism made in accordance with the present invention.

Referring to FIG. 1, the ribbon feed mechanism 10 is operable to feed a ribbon 12 at accurate metered feed increments in response to actuating a printing mechanism 14. The ribbon feed mechanism 10 includes a linkage 16 connected to the ribbon 12, a power roll 18 rotated by a motor (not shown) and a control means 20. The control means 20 is operable to couple the linkage 16 to the power roll 18 for incrementally feeding the ribbon 12.

The linkage 16 has an actuator 22 pivotally supported on a shaft 24. A pawl 26 is pivotally supported on the actuator 22 near one end thereof. A spring 28 biases the pawl 26 to a limited position in a counter-clockwise direction. A pin 30 is rigidly attached to the actuator 22 near a second end thereof. A bellcrank 32 is pivotally supported on a post 34. An arm 36 on the bellcrank 32 is positioned against the pin 30 on the actuator 22. A link 38 is connected at one end to a second arm 40 on the bellcrank 32. The link 38 is connected at the other end to an arm 42. The arm 42 is pivotally supported on a shaft 44 and is connected to the shaft 44 by a one-way drive spring clutch 46. A spring 48 is connected at one end to a rigid bracket 50 and is connected at the other end to the arm 42 for biasing the arm 42 in a counter-clockwise direction about the shaft 44. A multi-toothed cam 52 is rigidly attached to the shaft 44 for rotation therewith. Each tooth 54 on the multi-toothed cam 52 has a first cam surface 56 and a second cam surface 58. Two adjacent teeth 54 form a valley 60 therebetween. An arm 62 is pivotally supported on a post 64. A roller 66 is rotatably supported at an end of the arm 62. A spring 68 is connected at one end to the arm 62 and is connected at the other end to the bracket 50. The spring 68 biases the roller 66 into the valley 60 on the multi-toothed cam 52. A drive roller 70 is rigidly attached to the upper end of the shaft 44 for rotation therewith.

The ribbon 12 is installed into the typewriter by a cartridge 72 on a cartridge support 73. A supply spool 74 of the ribbon 12 is rotatably supported on a hub 76 in the cartridge 72. The ribbon 12 starting from the supply spool 74 is threaded around a roller 78, along an arm 80, reversed in direction at an end 82 of the arm 80, between a pinch roller 84 and the drive roller 70, around a roller 86 and on to a take-up spool 88. The take-up spool 88 has a gear 90 in mesh with a pinion 92 attached to the support 73. The pinion 92 is rigidly attached at the upper end to a shaft 94. A pulley 96 is rigidly attached at the lower end of the shaft 94. A pulley 98 is rigidly attached to the shaft 44. A closed loop coil spring 100 connects the pulley 98 to the pulley 96.

When the drive roller 70 is rotated by the linkage 16, the ribbon 12 is pulled from the supply spool 74 and moved along its threaded path. The ribbon 12 is then wound on the take-up spool 88 by the drive from the shaft 44, through the pulley 98, spring 100, pulley 96, pinion 92 and to the gear 90. A typical typewriter carriage 102 with a platen 104 is located adjacent the cartridge 72 and the printing mechanism 14.

The control means 20 has a bellcrank 110 pivotally supported on a post 112. A spring 114 is connected at one end to a frame 116 and is connected at the other end to a downward extending arm 118 of the bellcrank 110. The bellcrank 110 has an integral abutment 120 positioned adjacent the pawl 26. The bellcrank 110 has an integral finger 122 located between the abutment 120 and the post 112. A bellcrank 124 is pivotally supported on a post 126. A first integral arm 128 extends rearward from the bellcrank 124. A second integral arm 130 extends rearward from the bellcrank 124. A third integral arm 132 extends upward from the bellcrank 124. The third integral arm 132 has an integral step portion 134 near its free end. The bellcrank 124 has a spring anchor 136 integrally formed therefrom. A spring 138 is connected at one end to a post 140 rigidly attached to the frame 116. The spring 138 is connected at the other end to the spring anchor 136. The spring 138 biases the bellcrank 124 clockwise about the post 126 to a limited position determined by the third integral arm 132 abutting against the finger 122 of the bellcrank 110. The spring 114 biases the bellcrank 110 counter-clockwise about the post 112 to a limited position determined by the finger 122 abutting against the step portion 134 on the third integral arm 132.

Figure 2:
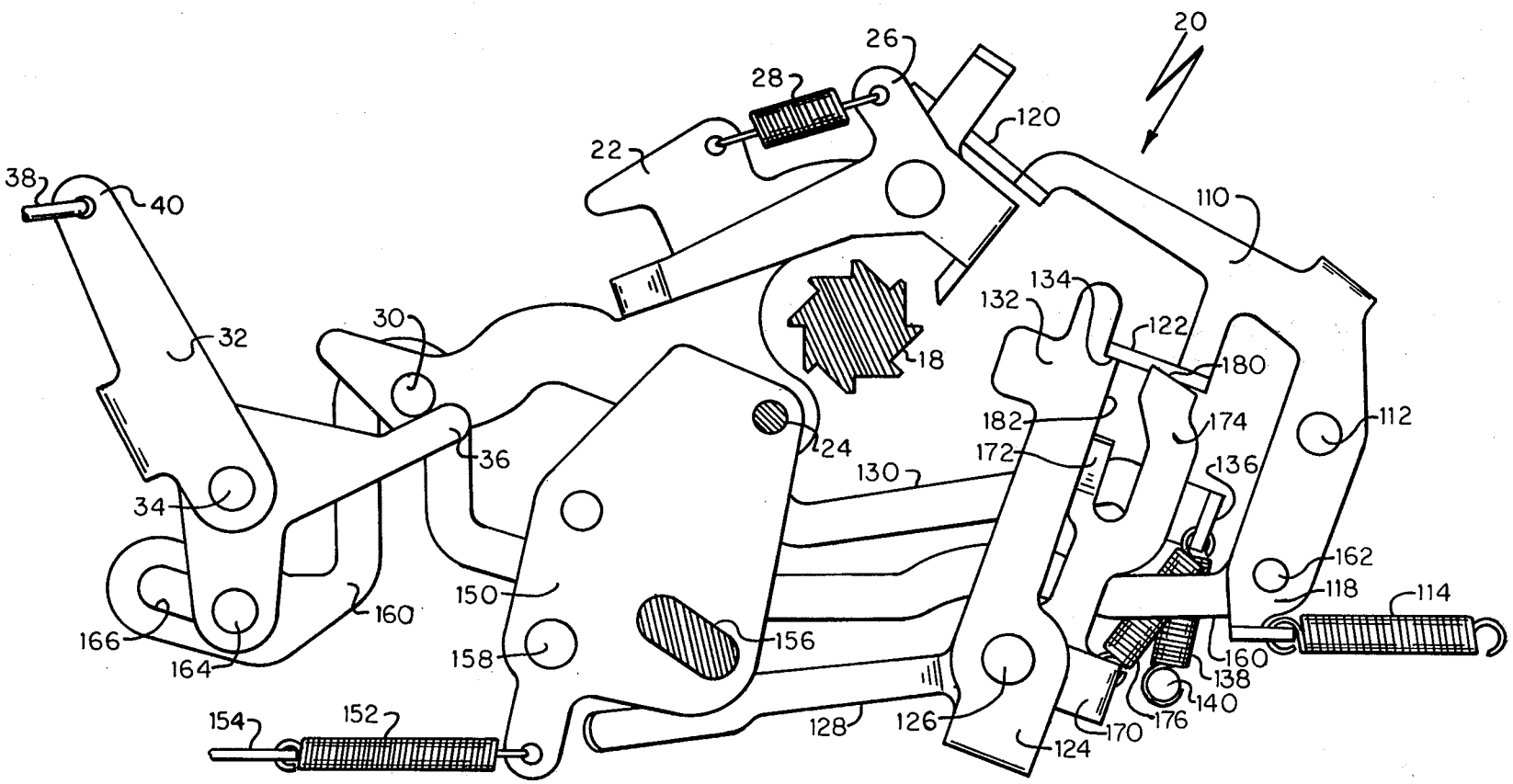
FIG. 2 is an enlarged left side elevational view of a portion of FIG. 1.

An arm 150 is pivotally supported on the shaft 24. A spring 152 is connected at one end to a spring anchor 154 (FIG. 2) and is connected at the other end to the arm 150. The spring 152 biases the arm 150 clockwise about the shaft 24. A universal bail 156 has one end rigidly attached to the arm 150. The universal bail 156 extends across the typewriter and is located adjacent the printing mechanism 14. A pin 158 is rigidly attached to the arm 150 in a direction opposite from the universal bail 156 and is located adjacent the first integral arm 128 of the bellcrank 124. A link 160 is connected at a forward end to the arm 118 of the bellcrank 110 by a shouldered pin 162. A pin 164 is rigidly attached to the bellcrank 32. The pin 164 extends through an elongated slot 166 (FIG. 2) in the rearward end of the link 160. A lever 170 is pivotally supported on the post 126. The lever 170 has a first integral finger 172 extending upward and has a second integral finger 174 extending upward. A spring 176 is connected at one end to the spring anchor 136 and is connected at the other end to the lever 170. The spring 176 biases the first integral finger 172 of the lever 170 against the third integral arm 132 of the bellcrank 124. The second integral finger 174 of the lever 170 extends upward to a position adjacent the finger 122 of the bellcrank 110.

OPERATION

The actuation of a printing mechanism 14 causes the universal bail 156 to rotate the arm 150 counter-clockwise about the shaft 24, viewing FIG. 1. The pin 158 carried by the arm 150 engages the first integral arm 128 of the bellcrank 124 and pivots the bellcrank 124 counter-clockwise about the post 126. The step portion 134 on the third integral arm 132 is removed from under the finger 122 of the bellcrank 110. The spring 114 biases the bellcrank 110 counter-clockwise about the post 112. The abutment 120 on the bellcrank 110 contacts and pivots the pawl 26 into engagement with the power roll 18.

Figure 3:
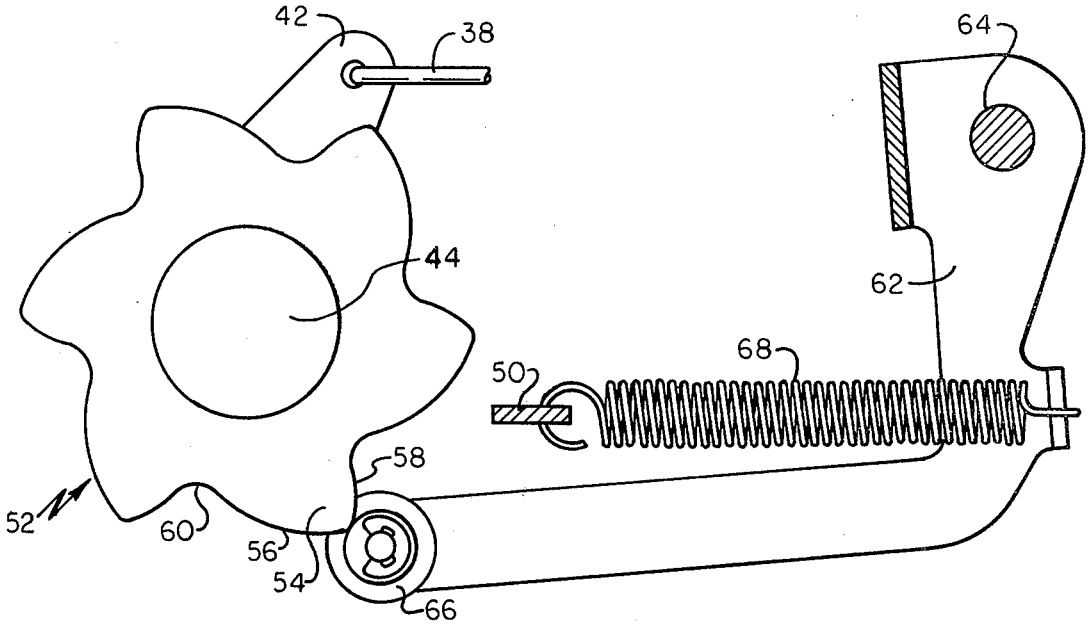
FIG. 3 is a top plan view showing the position of the cam after an initial segment of the feed increment.
Figure 4:
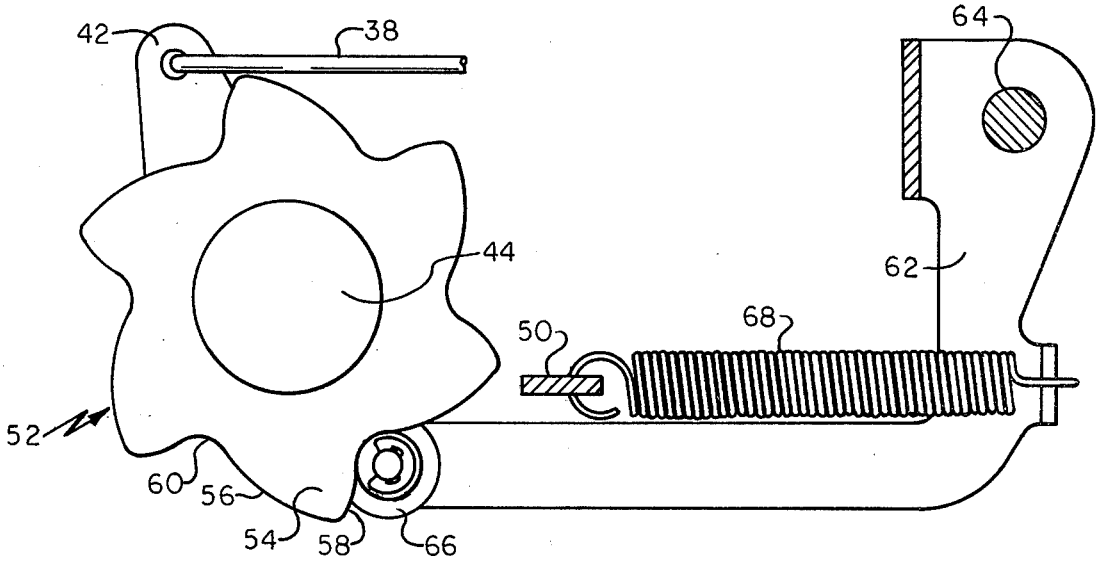
FIG. 4 is a top plan view showing the position of the cam after a final segment of the ribbon feed increment.

The power roll 18 pivots the actuator 22 counter-clockwise about the shaft 24. The pin 30 on the actuator 22 pivots the bellcrank 32 clockwise about the post 34. The bellcrank 32 pulls the link 38 forward which pivots the arm 42 clockwise about the shaft 44. The arm 42 drives the spring clutch 46 which drives the shaft 44 clockwise. The shaft 44 rotates the multi-toothed cam 52 clockwise an amount sufficient to drive the roller 66 from one valley 60, up the first cam surface 56, slightly over the apex of the tooth 54 and on to the second cam surface 58 (FIG. 3). The shaft 44 driven by the spring clutch 46 rotates the drive roller 70 which, in turn, feeds the ribbon 12 the initial segment of a feed increment, approximately 48° rotation of the shaft 44. As the roller 66 is driven up the first cam surface 56 by the power from the power roll 18, the tension of the spring 68 is increased. When the roller 66 has reached the second cam surface 58, the pawl 26 disengages from the power roll 18. The biasing force of the spring 68 on the roller 66 causes the roller 66 to drive down the second cam surface 58. The roller 66 thereby continues to rotate the multi-toothed cam 52 clockwise until the roller 66 seats in a succeeding valley 60 (FIG. 4). The roller 66 rotating the multi-toothed cam 52 is the result of the angle of the second cam surface 58 interfering with the path of the roller 66 when the roller 66 is driven down the second cam surface by the spring 68. When the roller 66 is seated in the valley 60, the roller 66 prevents overtravel and prevents back-up of the multi-toothed cam 52. The shaft 44 driven by the roller 66 rotates the drive roller 70 which, in turn, feeds the ribbon 12 the final segment of a feed increment, approximately 12° rotation of the shaft 44. For each feed increment of the ribbon 12, the ribbon 12 is wound onto the take-up spool 88 through the drive of the shaft 44, pulley 98, spring 100, pulley 96, pinion 92 and the gear 90. The increased tension of the spring 68, due to the roller 66 riding up the first cam surface 56, provides an additional biasing force on the roller 66 for efficiently rotating the multi-toothed cam 52 to feed the ribbon 12 the final segment of the ribbon feed and to rotate the take-up spool 88. Since the multi-toothed cam 52 is driven by the arm 42 through the spring clutch 46 until the roller 66 has reached the second cam surface 58 and since the pawl 26 is disengaged from the power roll 18 at this time, the roller 66 is operable to drive the multi-toothed cam 52 with a continuous motion for feeding the ribbon 12 a full feed increment with continuous motion, 60° rotation of the shaft 44. Feeding the ribbon 12 a full feed increment by the dual segment ribbon feed mechanism 10 with a continuous motion provides a smooth drive and minimizes part wear, part fatigue and frequency of repair.

The dual segment ribbon feed mechanism 10 is a non-precise mechanism which is operable to feed the ribbon 12 at arcuate metered feed increments. The linkage 16 is a non-precise mechanism by having loose tolerances throughout the linkage 16. The linkage 16 needed for the initial segment of the feed increment need only be operable to rotate the multi-toothed cam 52 until the roller reaches any position along the second cam surface 58. The final segment of the feed increment by the roller 66 will continuously rotate the multi-toothed cam 52 from any position along the second cam surface 58 until seating in a succeeding valley 60 to complete the full feed increment. Therefore, the initial segment can be made by a non-precise mechanism since the final segment of the feed increment will provide accurate metered feed increments by compensating for the non-precision of the initial segment.

When the pawl 26 disengages from the power roll 18, the biasing force of the spring 48 pivots the arm 42 counter-clockwise about the shaft 44. The arm 42 drives the link 38 rearward which pivots the bellcrank 32 counter-clockwise about the post 34. The bellcrank 32 pivots the actuator 22 clockwise about the shaft 24. The linkage 16 is thereby restored to its non-operative position.

Restoring the control means 20 to its non-operative position will now be described. During the ribbon feeding operation of the linkage 16, the pin 164 (FIG. 2) carried by the bellcrank 32, moves to the end of the slot 166 in the link 160 and drives the link 160 rearward. The link 160 pivots the bellcrank 110 clockwise about the post 112. If the step portion 134 of the third integral arm 132 has not returned to be engaged by the finger 122, then the extreme end 180 of the finger 174 is positioned below the finger 122. The finger 122 is then biased against the end 180 of the finger 174 by the spring 114 to hold the bellcrank 110 in the returned clockwise position.

During the printing operation of the printing mechanism 20, the pawl 26 disengages from the power roll 18. The spring 152 biases the universal bail 156 clockwise about the shaft 24 which removes the pin 158 from the first integral arm 128. The spring 138 biases the bellcrank 124 clockwise about the post 126 until the third integral arm 132, being in contact with finger 172, drives the extreme end 180 of the finger 174 from under the finger 122 and simultaneously positions the step portion 134 of the third integral arm 132 under the finger 122 of the bellcrank 110. If the third integral arm 132 has been returned clockwise by the spring 138 before the bellcrank 110 is returned clockwise by the link 160, then the finger 122 will slide upward along the edge 182 of the third integral arm 132 until the finger 122 is seated on the step portion 134 of the third integral arm 132.

What is claimed is:

1. A ribbon feed mechanism having a ribbon engaging means and a member operatively connected to the ribbon engaging means for driving the ribbon engaging means for incrementally feeding ribbon, the improvement comprising:

a first drive means including a power source operatively connected to the member for driving the member to advance the ribbon an initial segment of the feed increment; and a second drive means operatively connected to the member for driving the member to advance the ribbon a final segment of the feed increment with a continuous motion from the initial segment and upon disengagement of the first drive means from the power source.

2. A ribbon feed mechanism as defined in claim 1 wherein the member has a plurality of peripherally spaced teeth forming cam surfaces and the second drive means includes an element urged against one of the cam surfaces for driving the member the final segment of the feed increment.

3. A ribbon feed mechanism as defined in claim 1 wherein the member has a plurality of peripherally spaced teeth forming cam surfaces and the second drive means includes a roller, a pivotally supported arm supporting the roller and a spring connected to the arm for biasing the roller against one of the cam surfaces for driving the member the final segment of the feed increment.

4. A ribbon feed mechanism as defined in claim 1 wherein the member has a plurality of peripherally spaced teeth forming cam surfaces, the first drive means includes a clutch member operable by the power source for driving the member the initial segment of the feed increment, and the second drive means includes a roller, a pivotally supported arm supporting the roller and a spring connected to the arm for biasing the roller against one of the cam surfaces for driving the member the final segment of the feed increment.

5. A ribbon feed mechanism as defined in claim 3 wherein one of the cam surfaces pivots the arm and increases the biasing effect of the spring in response to the first drive means driving the member the initial segment of the feed increment.

6. A ribbon feed mechanism as defined in claim 1 wherein the member has a plurality of peripherally spaced teeth with valleys therebetween, each tooth has a first cam surface, an apex and a second cam surface, the second drive means includes a roller, a pivotally supported arm for supporting the roller and a spring connected to the arm for biasing the roller against the member in one of the valleys, the first drive means drives the member relative to the roller until the roller moves from the valley up the first cam surface, over the cam apex and on to the second cam surface of a tooth, and the roller of the second drive means being biased against the second cam surface of the tooth drives the member with continuous motion in the same direction as the first drive means.

7. A ribbon feed mechanism as defined in claim 6 wherein the roller of the second drive means is driven up the first cam surface of the tooth from the valleys to increase the biasing effect of the spring in response to the first drive means driving the member the initial segment of the feed increment.

8. A ribbon feed mechanism as defined in claim 1 wherein the member has a plurality of peripherally spaced teeth with valleys therebetween, and the second drive means includes a roller, a pivotally supported arm supporting the roller and a spring connected to the arm for biasing the roller against the member in each of the valleys to accurately hold the member after each feed increment.

9. A ribbon feed mechanism having a ribbon engaging means and a member operatively connected to the ribbon engaging means for driving the ribbon engaging means for incrementally feeding ribbon, the member having a plurality of peripherally arcuate spaced cam teeth with a valley between adjacent teeth the improvement comprising:

a first drive means operatively connected to the member for driving the member in one direction to advance the ribbon an initial segment of a feed increment; and a second drive means including a cam follower means biased against the member and advanced from one valley to a position past an apex of the next tooth by the movement of the member during the initial segment of a feed increment, the cam follower means being biasingly operable to drive the member, upon disengagement of the first drive means, with a continuous motion in the same direction as the initial segment of the feed increment until the cam follower means seats in a succeeding valley of the member thereby advancing the ribbon a final segment of the feed increment.

* * * * *